United States Patent [19]

Van-Ocker

[11] Patent Number: 5,040,461

[45] Date of Patent: Aug. 20, 1991

[54] LABEL PRINTING AND DISPENSING APPARATUS

[75] Inventor: William G. Van-Ocker, Southampton, Pa.

[73] Assignee: Avery International Corporation, Pasadena, Calif.

[21] Appl. No.: 438,730

[22] Filed: Nov. 17, 1989

[51] Int. Cl.[5] ..... B41F 1/08

[52] U.S. Cl. ..... 101/288; 400/120

[58] Field of Search ..... 101/288; 400/120; 355/76 PH

[56] References Cited

U.S. PATENT DOCUMENTS

| | | | |
|---|---|---|---|
| 4,000,393 | 12/1976 | Cochran et al. . | |
| 4,280,863 | 7/1981 | Hamisch, Jr. et al. . | |
| 4,417,517 | 11/1983 | Matsuda et al. | 101/288 |
| 4,422,376 | 12/1983 | Teracka | 101/69 |
| 4,481,518 | 11/1984 | Inui et al. | 396/76 PH |
| 4,505,603 | 3/1985 | Yana | 400/120 |
| 4,507,666 | 3/1985 | Kondo et al. | 396/76 PH |
| 4,507,667 | 3/1985 | Tsuhoi | 396/76 PH |
| 4,531,851 | 7/1985 | Kondo et al. | 400/583.3 |
| 4,544,287 | 10/1985 | Teraoka | 400/120 |
| 4,556,442 | 12/1985 | Torbeck | 101/288 |
| 4,568,950 | 2/1986 | Ross et al. | 101/288 |
| 4,579,466 | 4/1986 | Sato et al. | 400/120 |
| 4,598,302 | 7/1986 | Swidler et al. | 346/76 PH |
| 4,623,902 | 11/1986 | Yamanishi | 346/76 PH |
| 4,625,218 | 11/1986 | Watanabe | 346/76 PH |
| 4,639,739 | 1/1987 | Tsutsumi | 346/76 PH |
| 4,666,319 | 5/1987 | Hirosaki et al. | 400/120 |
| 4,687,358 | 8/1987 | Saitou | 400/208 |
| 4,739,341 | 4/1988 | Matsuno et al. | 346/1.1 |
| 4,754,290 | 6/1988 | Kitayama et al. | 346/76 PH |

FOREIGN PATENT DOCUMENTS

| | | | |
|---|---|---|---|
| 0179382 | 10/1984 | Japan | 400/120 |

*Primary Examiner*—Edgar S. Burr
*Assistant Examiner*—C. Bennett
*Attorney, Agent, or Firm*—Synnestvedt & Lechner

[57] ABSTRACT

A label printer and dispenser web transport system includes a motor driven platen and a print head resiliently directed against the platen between which an ink foil and label web are passed. The web travels over a triangular peeler bar disposed closely adjacent the platen and is then returned to the platen for passage between the platen and a spring biased idler roll deformably engaging the platen to maintain web tension over the peeler bar. The print head is pivotally mounted and is moved out of engagement with the platen when the print head is not printing. The ink foil is not advanced when the print head is moved away from the platen.

21 Claims, 3 Drawing Sheets

LABEL PRINTING AND DISPENSING APPARATUS

BACKGROUND OF THE INVENTION

The present invention relates generally to label printing and dispensing apparatus and relates more particularly to apparatus for the thermal printing of labels carried across a print head by a carrier web and thereafter dispensed from the web by passage of the web over a peeler bar.

Thermal transfer printing requires the precisely controlled feeding of the sheet being printed with respect to the print head heater elements known as the print line. Heat and pressure at the print line effect the transfer of waxed-based ink from the ink transfer foil to the paper surface.

For the printing of labels, the labels are conventionally presented to the print head in the form of spaced die-cut paper stock adhesively attached to a carrier web. The web is fed at a controlled rate across the print head by means of a motor driven roller which serves to pinch the web of labels and transfer foil against the print head with the print line being tangentially aligned with the roller. The label web is advanced by friction between the roller and the back surface of the web to provide a positive controlled drive of the web. The transfer foil, which travels with the web, acts as a sliding bearing surface against the smooth contact face of the print head.

Dispensing of the printed label from the web is accomplished by sharply changing the direction of travel of the web by passing the web over a sharp edge known as a peeler bar. This change of direction should be at least 100° and a substantial web tension must be maintained during its passage over the peeler bar in order to properly dispense the label. Upon leaving the web, the label is conventionally transferred by air jet to an applicator head on which it is held by vacuum. The applicator head is then moved into engagement with the product to be labelled which typically is passing thereby on a conveyor.

To maintain the proper tension over the peeler bar, it is conventional for label printing machines to utilize a second motor driven drive roller engaging the web downstream of the peeler bar. Since the web feed rate must be the same at both the primary and secondary drive rollers to maintain proper web tensioning, an additional complication is presented by a two motor web feed system. Because of difficulties inherent in equalizing the drive rate at both drive rolls, it has been conventional to drive the second roll by means of a slip clutch to effectively maintain a predetermined web tension.

As indicated, web tension control is an important aspect of this type of printer applicator, not only for maintaining a predetermined web feed past the print head but also for insuring a proper peeling of the labels from the web at the peeler bar. The web tension requirements of conventional label printers has been such as to require a peeler bar of substantial dimensions to provide sufficient strength to withstand the web tension without deformation. It has not heretofore been practical due to physical size restraints to design a drive roll and peeler bar assembly characterized by a distance between the print line and peeler bar edge of less than approximately ¾". This distance, which may be termed the "dead zone", is of particular importance since it determines the amount of label space which is not available for printing in certain situations. For so-called "on-demand" label printing, wherein each label is different, the information required for the printing of a given label may not be available before the previous label has been printed and dispensed. Even though the web drive is halted as the previous label clears the edge of the peeler bar, the leading edge of the succeeding label has already traveled past the print line and approached the peeler bar edge. To avoid sizeable non-printed areas of the labels, it would of course be possible to die-cut the labels to provide a space between labels substantially equal to the length of the dead zone. However, this solution wastes a substantial amount of label material, particularly in the case of small labels.

BRIEF SUMMARY OF THE INVENTION

The present invention employs a single drive roll and motor for advancing the web past the print head and over the peeler bar. The novel web transport system of the invention includes a motor driven platen having a resilient cylindrical surface which is mounted for rotation in alignment with a thermal print head. Means are provided for resiliently biasing the print head into engagement with the platen surface. Additionally, means are provided for feeding a web of labels between the platen as well as an ink transfer foil between the label web and the print head. A peeler bar of triangular shape is disposed closely adjacent the platen to change the direction of travel of the web to thereby sequentially dispense the labels therefrom to a label applicator. The web is returned to the platen approximately 90° beyond the print line and travels around the platen into the nip of an idler roll which is spring biased into engagement with the platen. The driving and tensioning effect provided by the idler roll is proportional to the spring biasing force with which the idler roll is directed against the platen. This force is adjusted such that the drive effect produced by the resilient engagement of the print head against the platen is substantially equal to or slightly greater than that produced by the idler roll.

Careful selection of the print head and idler roll biasing forces produces a reduction in the web tension at the peeler bar in comparison with conventional label printing equipment and permits a corresponding reduction in the necessary strength and size of the peeler bar, thus permitting the use of a smaller peeler bar with a consequent reduction in the dead zone between the peeler bar edge and the print line. A novel triangular shape of the peeler bar provides a particularly compact bar further aiding in the reduction of the dead zone which with the present invention may be only two thirds or less of that of conventional equipment.

In the present invention, the print head is pivotally mounted and means are provided for automatically moving the print head out of engagement with the platen and the ink foil and label web sandwiched therebetween when the print head is not printing. Means are also provided to interrupt the advance of the ink transfer foil when the print head is moved out of engagement with the platen, preventing waste of the relatively expensive foil. Supplemental web tensioning means are provided upstream of the platen for maintaining the tension of the label carrying web when the print head is moved out of engagement with the platen.

It is accordingly a first object of the present invention to provide a label printing and dispensing apparatus having an improved web transport system characterized by a single motor web drive mechanism for advancing the web past the print head and over the peeler bar.

A further object of the invention is to provide a label printer which is less complex, more compact and less expensive to manufacture than conventional label printers.

An additional object of the invention is to provide a label printer as described having a substantially smaller dead zone when utilized for on demand printing with a consequent saving of label stock.

Still another object of the invention is to provide a label printer as described which advances the ink transfer foil only during printing operation, thus providing significant savings in foil transfer foil consumption.

Additional objects and advantages of the invention will be more readily apparent from the following description of a preferred embodiment of the invention when considered together with the accompanying drawings.

DESCRIPTION OF THE PREFERRED EMBODIMENT

Figures 1, 2, 5:
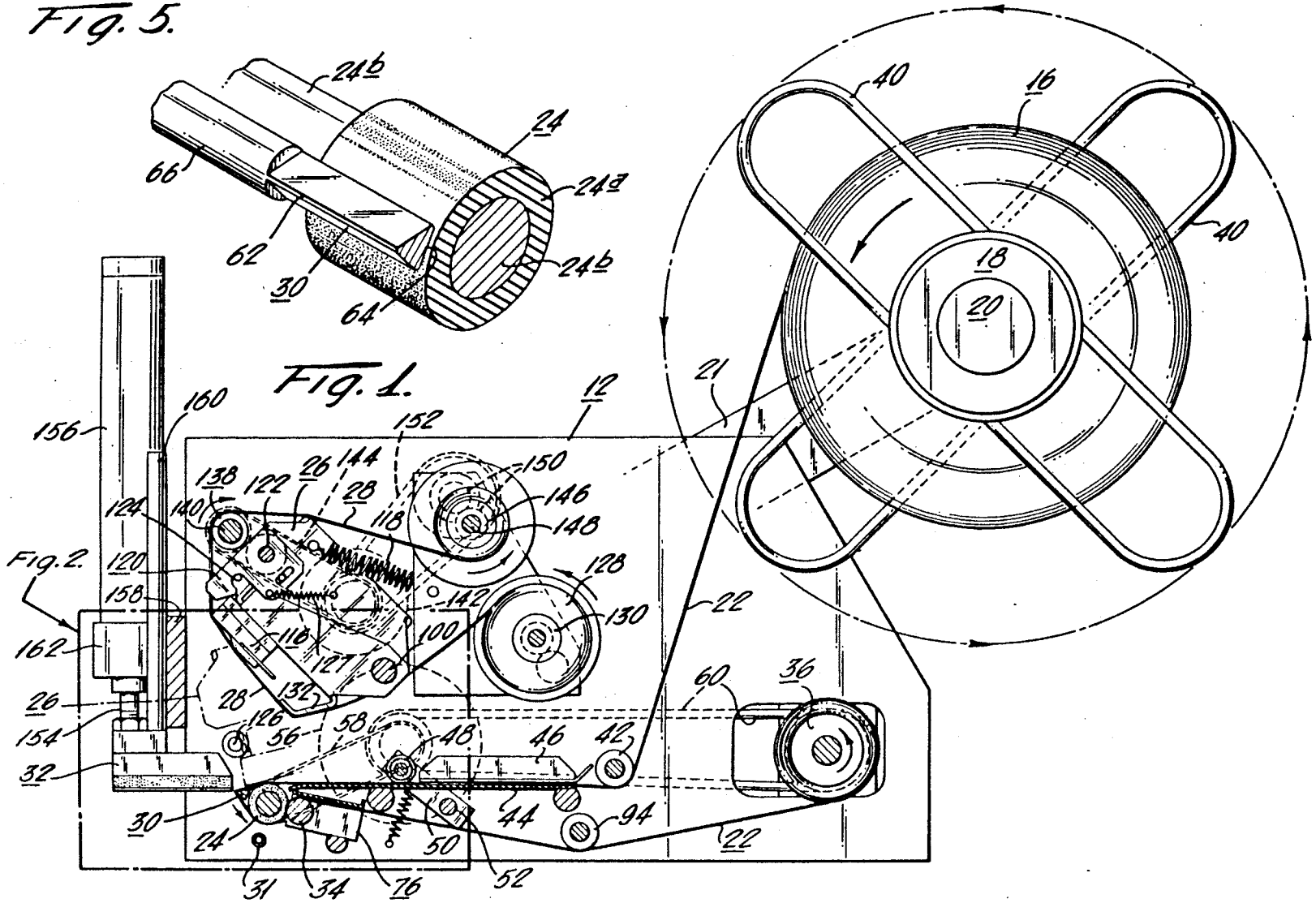
FIG. 1 is a side elevational view partly in section of a label printing and dispensing apparatus in accordance with the present invention.
FIG. 2 is an enlarged view of the area shown in broken lines in FIG. 1.
FIG. 5 is a partial sectional perspective view of the peeler bar and platen.
Figure 2:
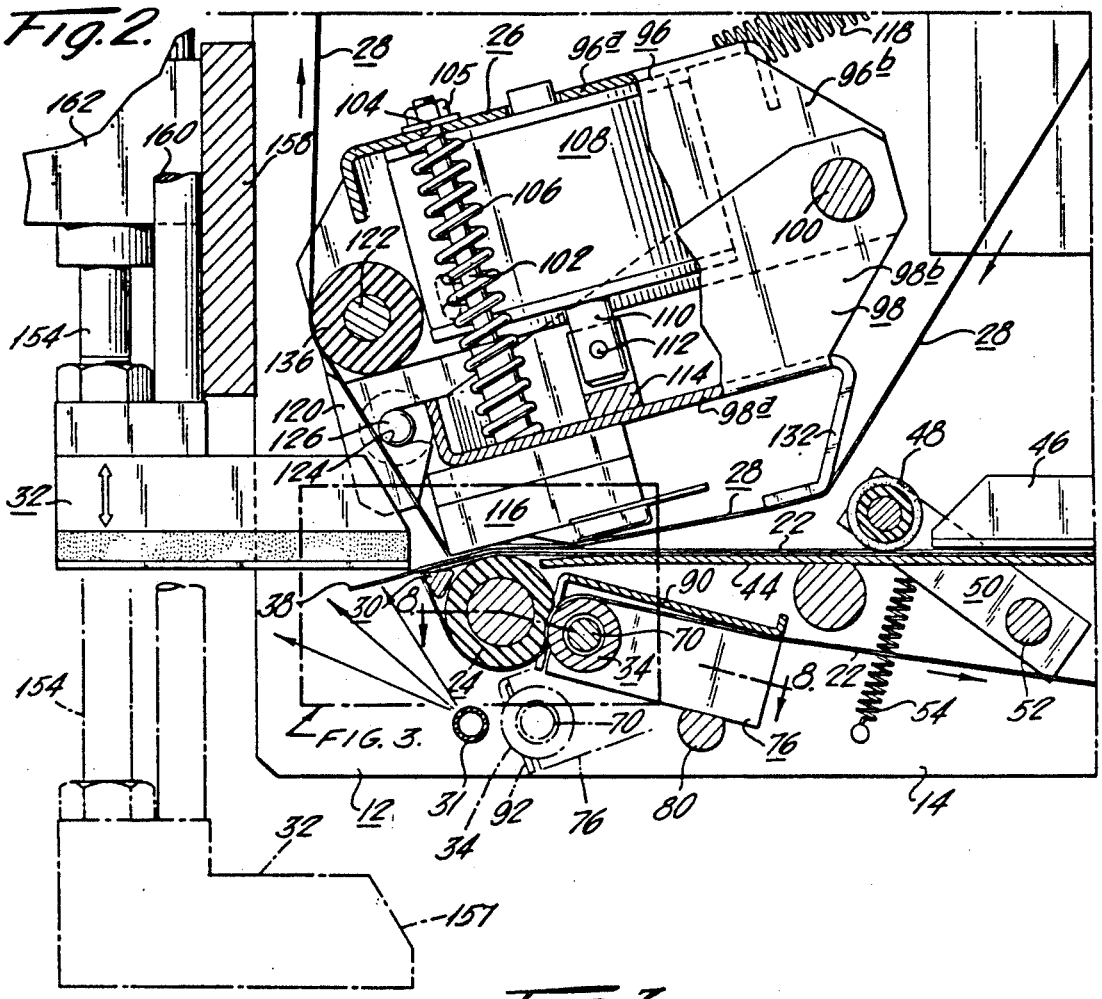

Referring to the drawings and particularly FIG. 1 thereof, a label printing and dispensing apparatus generally designated 10 includes a frame 12 comprised of a pair of spaced parallel side plates 14 between which the operative elements of the device are mounted. To facilitate an understanding of the invention, the major components of the apparatus and their function will first be briefly described, followed by a more detailed description.

A roll 16 of label stock to be printed is mounted on supply spool 18 rotatably mounted on a shaft 20 supported by arm 21 extending from the frame 12. A web 22 from the roll 16 is led to a platen 24 above which is disposed the print head assembly 26 having a print head print line tangentially aligned with the platen. An ink transfer foil 28 is passed beneath the print head in engagement with the web 22 to transfer a printed image to the labels carried by the web.

The web, following passage beneath the print head, passes across a peeler bar 30 around which its direction is sharply changed to peel the labels from the web, the labels being directed by an air jet from air tube 31 onto an applicator head 32 on which they are held by suction. The applicator head is moved downwardly to apply the labels to products passing beneath the machine. The web 22, following passage around the peeler bar 30, is returned to the platen 24 and, as best shown in FIG. 4 is passed between the platen and a spring biased idler roll 34 from which it is guided to a take-up spool 36.

Figure 7:
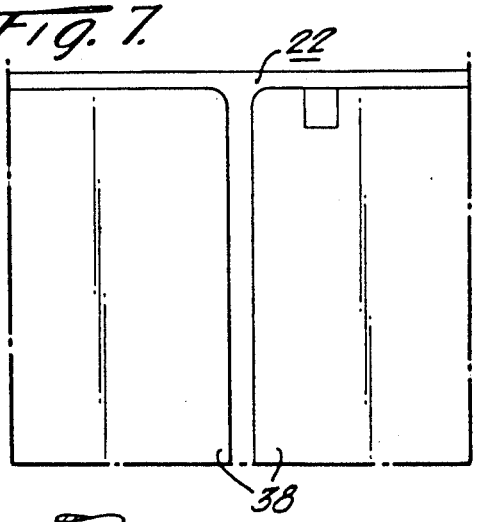
FIG. 7 is a view similar to FIG. 6 showing the close label spacing permissible with the printer of the present invention.

Considering the apparatus in more detail, the label carrier web 22 as shown in FIG. 7, comprises a continuous paper carrier sheet having a wax-like surface to which a series of discrete paper labels 38 are adhered by means of pressure sensitive adhesive. The labels 38 are die cut to suit the requirements of a particular labeling run and may vary in size and shape depending upon their particular application.

Web guides 40 are provided at each end of the spool 18 to maintain the alignment of the supply roll and web 22 as it is unrolled from the spool 16. Upon leaving the spool 16, the web 22 passes around a roll 42 onto a horizontal support plate 44, the labels 38 on the web facing upwardly. Spaced parallel web guides 46, which are adjustable to receive webs of various widths, are provided above the plate 44 to align the web in a precise predetermined path along the plate 44. A resilient hold-down roller 48 bears against the web and biases the web against the plate 44 adjacent the exit end of the guides 46. The roller 48 is rotatably mounted at each end on arms 50 which in turn are pivotally carried by shaft 52 extending between the side frames 14. Springs 54 attached to the frame side plates 14 bias the arms 50 and hence the roller 48 downwardly to provide a predetermined frictional engagement of the web 22 with the plate 44 to tension the web over the peeler bar in conjunction with the idler roll 34 during intervals when the print head is disengaged from the platen as described in more detail below.

Figure 3:
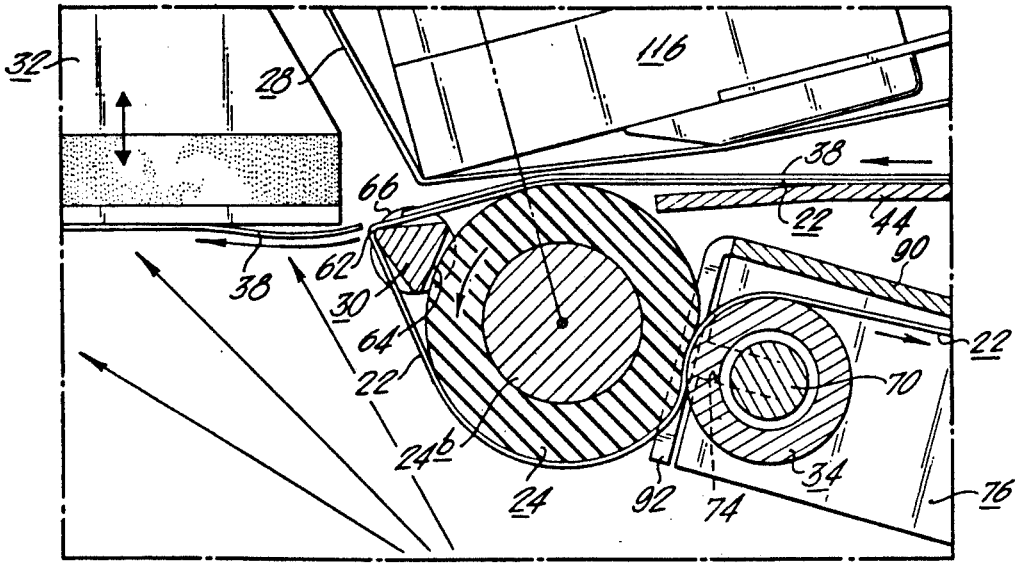
FIG. 3 is an enlarged view of the area shown in broken lines in FIG. 2 showing the print head and transfer foil disposed in spaced relation to the label web and platen.
Figure 4:
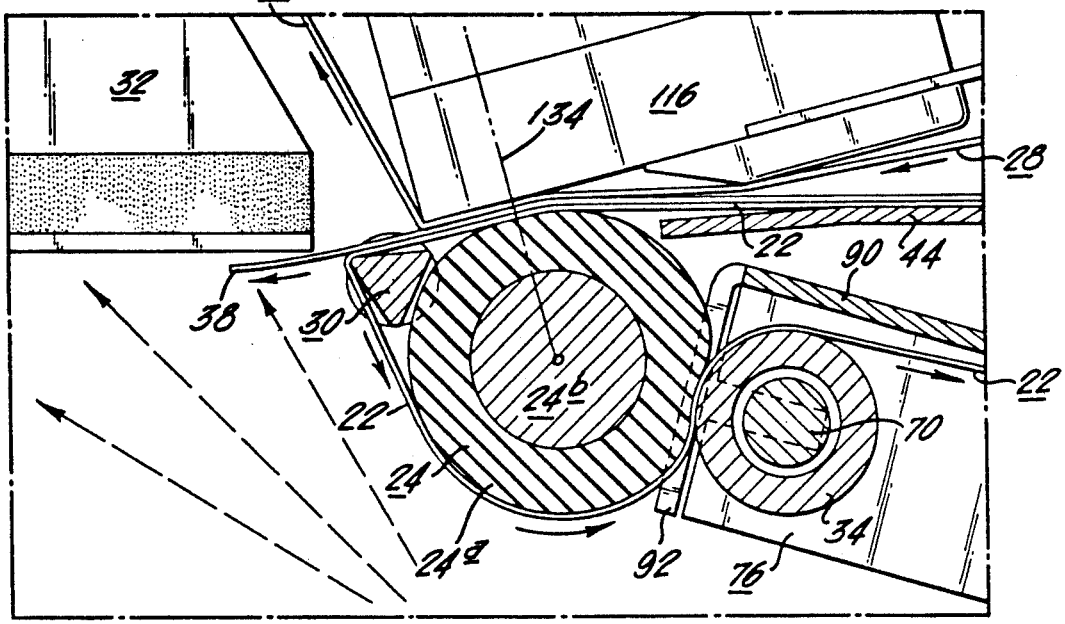
FIG. 4 is a view similar to FIG. 3 showing the print head and transfer foil disposed in biased engagement with the label web and platen.

As shown most clearly in FIGS. 3 and 4, the web upon leaving the support plate 44 passes over the platen 24. As shown in FIG. 5, the platen 24 comprises a deformably resilient roll **24*a* mounted on a rigid shaft 24*b* which is journaled between the frame side plates 14. When the print head is in the printing position and biased downwardly toward the platen as shown in FIG. 4, the cylindrical surface of the platen is deformed and thus increases the area of frictional contact of the platen with the web 22** resulting in an effective frictional drive of the web by the platen. The details of the print head and ink transfer foil advance mechanism are described in detail herebelow.

The platen is intermittently driven in rotation by a stepper motor 56 shown in broken lines in FIG. 1 which is connected to one end thereof by means of the timing belt 58. The motor 56 also drives the take-up spool 36 through a resilient drive belt 60. The motor 56 is started and stopped in response to signals generated by a microprocessor (not shown) which coordinates the platen movement with the print head operation.

The peeler bar 30 as shown in FIG. 5 is triangular in cross section, the outer edge 62, comprising one apex of the triangle, extending substantially diametrically outwardly from the platen center line. Since the outer edge of the peeler bar must define an angle of at least 100° in order to provide an effective peeling of the labels upon web passage, it can be appreciated that the triangular shape of the peeler bar maximizes the strength and hence the rigidity of the bar by utilizing most of the available space between the web and the platen. The inner face 64 of the peeler bar is disposed in close proximity to the platen outer surface to effectively take advantage of the limited space available. As shown in FIG. 5, the triangular peeler bar may be machined from round bar stock and the supporting peeler bar ends such as the end 66 illustrated in FIG. 5 retain the round bar shape.

Figure 8:
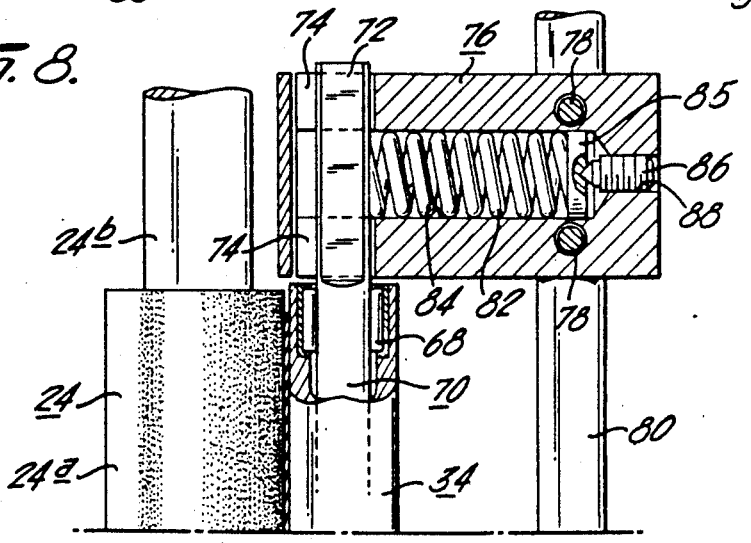
FIG. 8 is an enlarged view taken along line 8—8 of FIG. 2 and showing details of the idler roll support mechanism.

The idler roll 34 is disposed in substantially diametrically opposed relation to the peeler bar and comprises a hollow metal roller journaled by bearings 68 on a shaft 70 passing therethrough as shown in FIG. 8. The opposite ends 72 of the shaft 70 extend beyond the roll 34 and are machined on opposite sides to provide a substantially rectangular configuration. The shaft ends 72 are disposed in slots 74 of arms 76 which are secured by screws 78 to a transverse pivot shaft 80 rotatably supported between the frame plates 14. Compression coil springs 82 disposed within bore 84 of the arm 76 bear against the shaft end 72 at one end and against spring seat 85 at the other end to bias the shaft 70 and hence the roller 34 toward the platen 24. Set screws 86 disposed within threaded bores 88 bear against the spring seats 85 and permit adjustment of the biasing force of the springs 82. This described means for adjusting the biasing force of the idler roll 34 against the platen 24 is important in establishing the proper tension of the web 22 as described herebelow.

A guide plate 90 as best shown in FIG. 2 extends between the arms 76 and serves to direct the web 22 following passage over the idler roll 34. Retaining fingers 92 extend downwardly from each end of the guide plate 90 and prevent the ends 72 of the shaft 70 from moving out of the slot 74 of the arm 76 when the idler roll is disengaged from the platen during threading of the web. As shown in FIG. 2, the arm 76 and the shaft 70 and idler roll 34 are rotated downwardly to the dot-dash position shown to facilitate the threading of the web or for maintenance. A lever (not shown) outboard of the side plates 14 permits the selective movement of the idler roll from the operating position shown in solid lines in FIG. 2 to the lowered position shown in broken lines. It will be noted that the movement of the idler roll into its operating position passes across the line between the platen axis and the axis of the support shaft 80. Means (not shown) prevent further clockwise rotation of the idler roll assembly as viewed in FIG. 2, thus securing the idler roll in its "over center" biasing engagement with the platen.

The web 22 after passing over the idler roll 34 and beneath the guide plate 90 passes under a guide roll 94 and thence to the take-up spool 36. Although the building of the web on the spool increases its effective diameter and hence its peripheral speed, the resilient drive belt 60 and cooperating sheaves are designed to permit slippage to accommodate the web buildup without creating undue tension of the web.

The print head assembly 26 as best shown in FIG. 2 comprises an upper print head frame 96 and a lower print head frame 98, each of which are pivotally carried by a horizontal shaft 100 extending between the frame side plates 14. The upper frame plate 96 includes a transverse top plate **96*a*, and downwardly extending side plates 96*b* at each end thereof. Similarly, the bottom frame member 98 includes a transverse plate member 98*a* and upstanding side plate members 98*b*. The upper and lower print head frames 96 and 98 are pivotally mounted with respect to the frame 12 as well as each other by their connection to the shaft 100, which connection is at the extreme rear of the print head assembly. The pivotal movement of the upper print head frame with respect to the lower print head frame is limited by a pair of studs 102 axially spaced with respect to the platen. The studs are anchored at their lower ends to the lower print head frame plate 98*a* and pass through bores 104 in the upper print head frame plate 96*a*. Locknuts 105 on the threaded upper ends of the studs permit individual adjustment of the effective length of each stud. Compression springs 106 surrounding the studs 102 urge the plates 98*a* and 96*a* apart and hence into the limit position illustrated in FIG. 2 provided by the studs 102**.

A solenoid actuator 108 secured to the upper print head frame plate **96*a* includes a downwardly extending actuator shaft 110 which is connected by pin connection 112 to a clevis 114 secured to the lower print head frame plate 98*a*. Actuation of the solenoid 108 serves to draw the lower print head frame 98 toward the upper print head frame 96 against the force of the springs 106**.

A print head 116 is secured to the lower print head frame plate **98*a*** extending downwardly therefrom with the print line thereof aligned with the line of tangency of the print head with the platen when the print head is engaged with the platen. The thermal print head is of a conventional type and is connected to the apparatus microprocessor which controls operation of the electrical components of the apparatus.

The entire print head assembly 26 can be pivoted around the shaft 100 to a raised position shown in FIG. 1 in solid lines and is urged into and retained in this raised position by tension springs 118 at each side thereof extending between the frame side plates 14 and the print head upper frame 96. The print head assembly 26 is swung downwardly against the force of the springs 118 to the operating position shown in broken lines in FIG. 1 and in solid lines in FIG. 2 and is locked into the operating position by latches 120 on each side of the print head assembly pivotally mounted on the transverse shaft 122 extending between the print head upper frame side plates **96*b*. The latches 120 are pivotally actuated by a handle (not shown) on an extending end of the shaft 122 which passes through a slot in one of the frame side plates 14. Each latch 120 includes a slot 124 which engages a stud 126 protruding inwardly from the adjacent side plate 14. Springs 127 (FIG. 1**) serve to urge the latches into engagement with the studs.

Accordingly, in the operating position of the print head, with the latches 120 engaged with the studs 126, the upper print head frame 96 is rigidly held by the studs 126 and the shaft 100 in a fixed position with respect to the platen 24. The lower print head frame 98 as well as the print head 116 carried thereby remains pivotally movable about the shaft 100, being normally urged downwardly by the springs 106 such that the print head is spring biased against the platen 24, thereby pinching the intervening web 22 and ink transfer foil between the platen and print head. Upon actuation of the solenoid 108, the print head is moved a slight distance away from the platen to a spaced position shown in FIG. 3 to permit the stoppage of travel of the ink transfer foil 28 but the continued travel of the web 22 when the print head is not printing, thus preventing waste of the ink transfer foil. The travel of the print head lower frame 96 is a relatively small angular movement, and at the print head the travel away from the platen is approximately 1.5 mm.

The compression springs 106 which determine the biasing force of the print head against the platen are preferably chosen so that limitation of the deformation of the resilient platen by adjustment of the stud locknuts 105 is not required, in which case the locknuts serve principally to limit the relative rotation of the upper and lower print heads. Should the label web have a narrow width, a substantial portion of the print head will be directly engaged with the platen, resulting in high frictional drag forces. To relieve the platen drive from this frictional drag, the locknut 105 of the stud 102 above the platen-engaged print head portion is tightened to limit the permissible displacement of one end of the print head. In the illustrated embodiment, such adjustment would be made with the locknut 105 illustrated which is at the front of the printer, since the back edge of the label web is, regardless of web width, disposed at the back of the printer.

The ink transfer foil is delivered to the print head from a roll 128 mounted on spool 130 extending between the frame side plates 14. The foil passes around a foil guide element 132 extending from the lower print head frame 98 from which it passes beneath the print head 116 in intimate contact with the print line, being urged thereagainst by the biasing of the print head against the platen of the springs 106. This relationship of the print head, ink foil, label web and platen in the printing position is most clearly shown in the enlarged view of FIG. 4, the print line of the print head being aligned with the line of tangency of the print head and platen which is in the plane delineated by the dot-dash line 134 of FIG. 4.

Following passage around the print head, the ink foil passes upwardly around an idler roll 136 on the shaft 122 and thence to a drive roller 138 mounted on the shaft 140 journaled between the side plates 14. The drive roller 138 and shaft 140 are intermittently driven in rotation by a stepper motor 142 connected thereto by a timing belt 144. The stepper motor operation is controlled by the microprocessor described herebefore which also controls the print head as well as the stepper motor 56.

The ink foil following passage over the drive roller 138 is collected on the take-up spool 146 mounted on the shaft 148 extending between the side plates 14, which shaft is driven through a gear train 150 and an overrunning clutch by a drive belt 152 connected with the stepper motor 142.

The label applicator head 32 is connected to the actuating rod 154 of a pneumatic cylinder 156, the valves (not shown) of which are electrically controlled by the microprocessor to move the applicator head at the proper time to a label applying position 157 shown in broken lines in FIG. 2. The head has a foraminous lower surface connected with a vacuum line (not shown) as conventional to hold a label in position for application. The cylinder 156 is mounted on a frame member 158 attached to the frame 12. Guide posts 160 attached to the applicator head pass through a cylinder mounting bracket 162 on the frame member 158 to maintain the applicator head in the proper alignment. The frame member 158 is preferably pivotally mounted to the frame 12 to permit access to the print head and label web transport mechanism to facilitate the threading of the foil and web, changing of the print head and the servicing of the apparatus.

For operation, a label web supply roll is mounted on the spool 18 and threaded through the web transport apparatus in the manner described, the end thereof being led onto the take-up spool 36. To facilitate threading of the web, the print head assembly 26 is moved to the elevated position shown in FIG. 1 and the idler roll 34 is dropped to its lower position shown in FIG. 2. A roll of ink transfer foil is placed on the spool 130 and is passed around the print head onto the take-up spool 46. The print head is then lowered to its operating position shown in FIG. 2 with the latches 120 being locked onto the studs 126. The idler roll 34 is moved to its operating position shown in FIG. 2 and the set screws 86 are adjusted to provide a biasing force of the idler roll against the platen and web pinched therebetween equal to or slightly greater than the force provided by the print head against the platen to establish the proper tension of the web over the peeler bar. Since it has been found that the frictional drive accorded the web is substantially proportional to the amount of deflection of the resilient platen surface and hence the area of contact between the platen and the web, it can be understood that an increase in the spring force urging the idler roll into engagement with the platen will directly control the degree of tension in the web passing over the peeler bar. Control of the web tension by the adjustable idler roll permits an adequate degree of tension in this critical section of the web run to provide a proper label peeling effect without unduly loading the peeler bar.

With the apparatus set up as described, the operation of the printer and dispenser is entirely electrically controlled by the microprocessor and the apparatus can thus be remotely controlled. Printing and dispensing can either be on a continuous basis such as when an entire production run of goods is to receive the same label information, or on an "on demand" basis when the label is custom printed for each labeled package or product. In either case, the apparatus functions in the same manner, the labels passing under the print head receiving the printed indicia by the selective heating of the line elements in a conventional manner. On completion of the printing of each label, the solenoid 108 is actuated to raise the print head into the spaced relationship in shown FIG. 3, and the stepper motor 147 controlling the transfer foil drive is stopped to halt the foil movement.

The printed label on passing over the peeler bar is peeled from the web in the manner shown in FIG. 4 and is carried by an air blast from the air pipe 31 onto the applicator head 32 as shown in FIG. 3. The applicator head is then driven downwardly by cylinder 156 to apply the label to an article passing beneath the apparatus. When the succeeding label is in position for printing, the solenoid is released, and the springs 106 return the print head into engagement with the platen and the printing cycle again commences. It can be appreciated that the raising of the print head from the platen when the print head is not printing and the halting of the ink foil advance during this period prevents any waste of the print foil. Tension in the label web when the print head is raised is maintained by the spring loaded roll 48 which, in conjunction with the idler roll 34, maintains the proper web tension over the peeler bar.

The utilization of a triangular shaped peeler bar and the relatively low web tension required with the present web transport system permits a reduction in the so-called "dead zone" between the outer edge 62 of the peeler bar and the print line which is centered along the plane 134. Although in conventional equipment a dead band of 0.600" or greater has been considered acceptable, in the present apparatus this distance has been reduced to approximately 0.400". This results in a saving of approximately one third of the label space formerly lost with conventional equipment, and, depending in degree on the size of the labels being run, a significant savings in wasted label stock.

Figure 6:
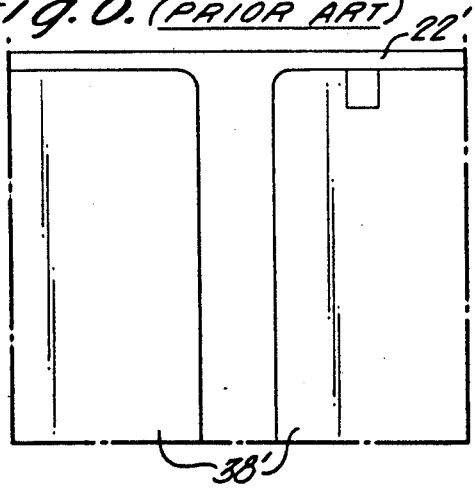
Fig. 6. (PRIOR ART)
FIG. 6 is a partial plan view of a prior art label carrying web showing the wide label spacing typical of prior art printers having a large dead band.

An illustration of the economy provided by the invention is illustrated in the comparison between FIG. 6 representing the prior art and FIG. 7 wherein labels of the same size are spaced on the web in accordance with the dead zone area characteristic of the apparatus with the unprinted portions of the labels being the same. In FIG. 6 it will be noted that the prior art labels 38' are widely spaced in contrast to the closely spaced labels permissible with the present invention as shown in FIG. 7.

The single motor drive of the present web transport system results in a less complex, more compact and less expensive apparatus in addition to the economies recited in operation with respect to savings in both the transfer foil and the label stock.

Manifestly, changes in details of construction can be effected by those skilled in the art without departing from the invention.

I claim:

1. Apparatus for printing and dispensing labels from a label web carrying a plurality of spaced pressure sensitive labels, said apparatus comprising, a frame, a platen mounted for rotation on said frame, said platen having a deformable resilient cylindrical surface, a motor connected with said platen for selective rotation thereof, a thermal print head mounted on said frame in alignment with said platen, means for resiliently biasing said print head into engagement with said platen surface, means on said frame for feeding the label web between said platen and said print head, means on said frame for feeding an ink transfer foil between the label web and said print head, a peeler bar disposed closely adjacent said platen to receive and change the direction of travel of the label web following passage thereof beneath said print head to thereby dispense the labels therefrom, an idler roll mounted on said frame parallel to and in engagement with said platen to receive the web therebetween following passage thereof over said peeler bar, and adjustable spring means for continuously biasing said idler roll and web against said platen to resiliently deform said platen and effect a controlled tensioning of the web over said peeler bar.

2. The invention as claimed in claim 1 including means for moving said print head and ink transfer foil out of engagement with said web and platen when said printhead is not printing.

3. The invention as claimed in claim 2 wherein said means for feeding the ink transfer foil includes means for interrupting the advance of said ink foil when said print head is moved out of engagement with said platen and ink foil.

4. The invention as claimed in claim 2 including means for maintaining the tension of said web upstream of said platen when said print head is moved out of engagement with said platen and ink foil.

5. The invention as claimed in claim 1 wherein said peeler bar is triangular in cross-section.

6. The invention as claimed in claim 1 wherein said means for rotating said platen comprises a stepping motor.

7. The invention as claimed in claim 1 wherein said means for feeding said ink transfer foil comprises a stepping motor.

8. The invention as claimed in claim 1 wherein said peeler bar is disposed with respect to said platen and print head such that said web is returned to said platen following passage over said peeler bar substantially 90° from the line of tangency of said print head with said platen.

9. The invention as claimed in claim 1 wherein said idler roll engages said platen at a point substantially diametrically opposed from said peeler bar.

10. Apparatus for printing and dispensing labels from a label web carrying a plurality of spaced pressure sensitive labels comprising, a frame, a platen mounted for rotation on said frame, said platen having a deformable resilient cylindrical surface, a stepping motor connected to said platen for selective rotation thereof, a thermal print head assembly pivotally mounted on said frame, said print head assembly comprising a print head having a print line aligned with said platen, means for resiliently biasing said print head into engagement with said platen surface, means for feeding the label web between said platen and said print head, means for feeding an ink transfer foil between the label web and said print head, said latter means comprising a stepper motor, a peeler bar disposed closely adjacent said platen to receive and change the direction of travel of the label web following passage thereof across said print head to thereby dispense the labels therefrom, an idler roll mounted on said frame parallel to and in engagement with said platen to receive the web therebetween following passage thereof over said peeler bar, adjustable spring means for continuously biasing said idler roll and web against said platen, and means for moving said print head and ink transfer foil out of engagement with said web and platen when said print head is not printing, and means for feeding the ink transfer foil including means for interrupting the advance of the ink foil when said print head is not printing.

11. The invention as claimed in claim 10 including means for maintaining the tension of said web upstream of said platen when said print head is moved out of engagement with said platen and ink foil.

12. The invention as claimed in claim 10 wherein said peeler bar is triangular in cross-section.

13. The invention as claimed in claim 10 wherein said peeler bar is disposed with respect to said platen and print head such that said web is returned to said platen following passage over said peeler bar substantially 90° from the line of tangency of said print head with said platen.

14. The invention as claimed in claim 10 wherein said idler roll engages said platen at a point substantially diametrically opposed from said peeler bar.

15. The invention as claimed in claim 10 including means for adjusting the biasing force of said idler roll against said platen.

16. The invention as claimed in claim 10 including applicator means for receiving the labels dispensed from said web at said peeler bar.

17. The invention as claimed in claim 16 including means for directing said labels from said web onto said applicator means.

18. The invention as claimed in claim 17 wherein said latter means comprises an air jet.

19. Apparatus for printing and dispensing labels from a label web carrying a plurality of spaced pressure sensitive labels, said apparatus comprising, a frame, a platen mounted for rotation on said frame, said platen having a deformable resilient cylindrical surface, a stepping motor connected to said platen for selective rotation thereof, a thermal print head assembly pivotally mounted on said frame, said print head assembly comprising upper and lower print head frames, means for locking said upper print head frame into a fixed position on said printer frame, a print head on said lower print head frame having a print line aligned with said platen, means for resiliently biasing said lower print head frame away from said upper print head frame to resiliently bias said print head into engagement with said platen, means for feeding the label web between said platen and said print head, means for feeding an ink transfer foil between said label web and said print head, said latter means comprising a stepper motor, a peeler bar disposed closely adjacent said platen to receive and change the direction of travel of the label web following passage thereof across said print head to thereby dispense the labels therefrom, an idler roll mounted on said frame parallel to and in engagement with said platen to receive the web therebetween following passage thereof over said peeler bar, adjustable spring means for continuously biasing said idler roll and web against said platen to resiliently deform said platen and effect a controlled tensioning of the web over the peeler bar, means for selectively moving said lower frame toward said upper frame to move said print head and ink transfer foil out of engagement with said web and platen when said print head is not printing, and means for interrupting the advance of said ink foil when said print head is not printing.

20. The invention as claimed in claim 19 including means for adjustably limiting the displacement of said print head toward said platen.

21. The invention as claimed in claim 20 wherein said print head includes first and second ends and therein said latter means comprises a plurality of adjustment means to permit selective adjustment of the displacement limit of each end of said print head.

* * * * *

UNITED STATES PATENT AND TRADEMARK OFFICE

CERTIFICATE OF CORRECTION

PATENT NO. : 5,040,461

DATED : August 20, 1991

INVENTOR(S) : William G. Van-Ocker

It is certified that error appears in the above-identified patent and that said Letters Patent is hereby corrected as shown below:

Col. 1, line 67, after "approximately" and before the period change "3/4"" to --5/8"--

Signed and Sealed this

Twenty-ninth Day of December, 1992

*Attest:*

DOUGLAS B. COMER

*Attesting Officer*

*Acting Commissioner of Patents and Trademarks*